US006056641A

United States Patent [19]

Webb

[11] Patent Number: 6,056,641

[45] **Date of Patent: *May 2, 2000**

[54] APPARATUS FOR PLAYING CARD GAMES

[75] Inventor: Derek J. Webb, Derby, United Kingdom

[73] Assignee: Shuffle Master, Inc., Eden Prairie, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/889,919

[22] Filed: Jul. 10, 1997

Related U.S. Application Data

[62] Division of application No. 08/504,023, Jul. 19, 1995, Pat. No. 5,685,774.

[30] Foreign Application Priority Data

Jul. 22, 1994 [GB] United Kingdom ..... 9414822
Dec. 29, 1994 [GB] United Kingdom ..... 9426324

[51] Int. Cl.[7] ..... A63F 1/00; A63F 9/22

[52] U.S. Cl. ..... 463/13; 273/292

[58] Field of Search ..... 273/292, 274, 273/309; 463/12, 13, 43

[56] References Cited

U.S. PATENT DOCUMENTS

| | | | |
|---|---|---|---|
| 4,743,022 | 5/1988 | Wood | 463/13 |
| 4,836,553 | 6/1989 | Suttle et al. | 273/292 |
| 4,861,041 | 8/1989 | Jones et al. | 273/292 |
| 5,022,653 | 6/1991 | Suttle et al. | 273/85 CP |
| 5,046,736 | 9/1991 | Bridgman et al. | 463/26 |
| 5,098,107 | 3/1992 | Boylan et al. | 273/292 |
| 5,174,579 | 12/1992 | Griffiths | 273/292 |
| 5,257,784 | 11/1993 | Boylan et al. | 273/138.2 |
| 5,257,810 | 11/1993 | Schorr et al. | 273/292 |
| 5,265,877 | 11/1993 | Boylan et al. | 273/139 |
| 5,275,415 | 1/1994 | Wisted | 273/274 |
| 5,288,081 | 2/1994 | Breeding | 273/292 |
| 5,294,128 | 3/1994 | Marquez | 273/292 |
| 5,308,065 | 5/1994 | Bridgeman et al. | 463/13 |
| 5,366,228 | 11/1994 | Kangsanaraks | 273/292 |
| 5,377,973 | 1/1995 | Jones et al. | 463/12 |
| 5,431,408 | 7/1995 | Adams | 273/306 |
| 5,630,757 | 5/1997 | Gagin et al. | 463/43 |
| 5,685,774 | 11/1997 | Webb | 463/13 |

FOREIGN PATENT DOCUMENTS 667345 2/1952 United Kingdom .

*Primary Examiner*—Benjamin H. Layno
*Attorney, Agent, or Firm*—Schwegman, Lundberg, Woessner & Kluth, P.A.

[57] ABSTRACT

An electronic poker gaming device which provides at least one player with the option of placing a first wager against either a predetermined payout schedule, a dealer's hand, or both. After this first wager is placed, three cards representing a dealer's hand are then dealt face down, and three cards representing the player's hand are dealt face up. After inspecting the player's hand of three cards, the gaming device provides an opportunity for the player to place a second wager that the player's three card hand exceeds the dealer's three card hand, or the player may forfeit the first first wager. According to another aspect, each player is provided with a wild card which is retained and used repeatedly by a player in each hand. The wild card may take a novel promotional form and is preferably more durable than the standard playing cards.

42 Claims, 4 Drawing Sheets

BRIT-BRAG

| ANTE WINS EXTRA BONUS | | PAIR PLUS WIN PAYS |
|---|---|---|
| | PAIR | 1 TO 1 |
| | FLUSH | 4 TO 1 |
| 1 TO 1 | RUN | 6 TO 1 |
| 4 TO 1 | TRIPS | 30 TO 1 |
| 5 TO 1 | BRAG | 40 TO 1 |

25

APPARATUS FOR PLAYING CARD GAMES

This is a division application of U.S. application Ser. No. 08/504,023, filed Jul. 19, 1995, U.S. Pat. No. 5,685,774.

The present invention relates to games and, more particularly to card-type games which are particularly suitable for use in gaming establishments.

BACKGROUND OF THE INVENTION

Casinos and leisure establishments continually require new games to offer their clientele. Such games are generally required to enable each player to play against a banker (who usually also acts as dealer) provided by the casino, rather than against other players. Alternatively, in a "card room" game each player may have the option to act as banker, whilst the establishment runs the game on behalf of the banker and takes fees from the players.

Players typically enjoy games which can be played rapidly and which offer players a plurality of choices. A plurality of choices heightens player interest in games. It would therefore be desirable to provide card games comprising a plurality of new wagering options.

SUMMARY OF THE INVENTION

One embodiment of the present invention comprises a method of playing a card game comprising a dealer and at least one player comprising the steps of:

establishing a hierarchy of a plurality of possible hands;

establishing a predetermined plurality of winning card combinations;

providing at least one player with a plurality of wagering options, wherein said wagering options at least comprise:

(a) said player's hand attaining at least one of said predetermined plurality of winning combinations; and (b) said player's hand having a higher ranking than a hand of said dealer;

displaying a plurality of indicia of playing cards to form at least one player's hand and a dealer's hand; and resolving wagers of said at least one player.

According to another embodiment of the present invention, there is provided a method of playing a card-type game involving one or more persons acting as a dealer and a banker, and at least one player, the method comprising the steps of:

(a) the or each player placing a wager (i) that the player's hand will be greater than a first predetermined rank, where all possible hands are ranked according to predetermined rules; or (ii) that the player's hand will beat the dealer; or (iii) a combination of the above;

(b) the dealer dealing to each player (including himself) a hand of cards;

(c) the or each player who placed a wager according to (ii) above inspecting his or her hand and deciding either to forfeit the original wager to the banker or to place a further wager;

(d) the dealer revealing his hand and determining whether it exceeds a second predetermined rank; and if the dealer's hand does not exceed the second predetermined rank, the banker paying each player an amount based on the wager according to (ii) above and returning the further wager to the player, or if the dealer's hand exceeds the second predetermined rank, comparing the dealer's hand in turn with that of each other player who placed a wager according to (ii) above and if the player's hand is higher, the banker paying the player an amount based on both initial and further wagers, and if the player's hand is lower, the player forfeiting both wagers to the banker;

(e) the banker paying in accordance with a predetermined scale any player who placed a wager according to (i) above and whose hand exceeds the first predetermined rank.

The dealer may also act as banker. The player's cards may be dealt unseen or seen. The cards preferably form a standard 52-card deck. Preferably the hand comprises three cards.

In the case of one preferred three card version of the game, hands are preferably ranked as follows, where A=ace, K=king, Q=queen, J=jack and numbers 10 to 2 designate the other cards:

| | | | |
|---|---|---|---|
| Highest: | BRAG: | Three of one suit in sequence | |
| | | AKQ | highest ranking brag |
| | | KQJ | next highest ranking brag |
| | | QJ10 | next highest ranking brag, and so on until |
| | | 32A | lowest ranking brag |
| | TRIPS: | Three of One Rank | |
| | | AAA | highest |
| | | KKK | next highest ranking trips, and so on until |
| | | 222 | lowest ranking trips |
| | RUN: | Three of mixed suits in sequence | |
| | | AKQ | highest ranking |
| | | KQJ | next highest ranking, and so on, until |
| | | 32A | lowest ranking |
| | FLUSH: | Three of One Suit | |
| | | AKJ | highest ranking |
| | | AK10 | next highest, and so on, until |
| | | 532 | lowest ranking |
| | PAIR: | Two of Same Rank | |
| | | AAK | highest ranking |
| | | AAQ | next highest ranking, and so on, until |
| | | 223 | lowest ranking |
| Lowest: | HIGH CARD | (a hand comprising none of the above) | |
| | | AKJ | highest ranking |
| | | AK10 | next highest ranking, and so on, until |
| | | 532 | lowest ranking |
| | Ace is high, but can be low in 3-2-A Sequence. | | |

For hands other than three cards, rankings would be suitably changed as would predetermined ranks and payouts. Those skilled in the art will appreciate that various other names may be used for the hands in the illustrative hierarchy set forth herein. For example, BRAG may also be known as a straight flush or bouncer; TRIPS may also be known as three of a kind or PRILE; and a RUN may also be known as a STRAIGHT.

Preferably an additional payout is made by the banker to any player who has made an initial wager according to (ii) above and a further wager, and whose hand is any of a number of specified high ranking hands. The payout may be made in accordance with a predetermined scale. For example, one possible payout follows:

BRAG 5 to 1

TRIPS 4 to 1

RUN 1 to 1

Alternatively the payout may be 7 to 5 for a run or higher ranking hand. The payout is preferably based on the amount of the initial wager.

The first predetermined rank is preferably a pair. The payout scale for wagers according to (i) above is preferably as follows:

BRAG 40 to 1

TRIPS 30 to 1

RUN 6 to 1

FLUSH 4 to 1

PAIR 1 to 1

Alternatively the payout may be 14 to 5 for a pair or higher ranking hand. Those skilled in the art will appreciate that the payouts may be varied without departing from the scope of the present invention.

The second predetermined rank is preferably a higher card hand containing a queen.

Furthermore, if desired, an additional wager may be placed on the total numerical value of a player's hand. In this case picture cards preferably count ten points, aces one point and the other cards two to ten points, the total being compared to the dealer's total and the higher total winning. Tied hands may be won by the dealer or half stakes won by the dealer on tied hands.

The method may further comprise the step of permitting or requiring a player to place a wager on a fixed or variable extra bonus jackpot.

Another embodiment of the present invention comprises the steps of:

designating at least one playing card indicia as a wild indicia;

providing each player with at least one of said wild indicia for repeated use by said player; and playing a plurality of card hands wherein said wild indicia is used repeatedly in each of said hands.

In an alternative three-card embodiment of the present invention, each player receives two standard playing cards plus a wild card which the player combines with the standard cards to make a three-card hand. The payout scale and predetermined ranks may be chosen or modified to reflect the increased probability of a high ranking hand being produced.

In a four-card version of the game, each player may receive a wild card which the player may place with each four-card hand to make a five-card poker hand. A similar wild card may be used in a five-card game, each player discarding a card and substituting this wild card to make a five-card poker hand. In either case the dealer is preferably also provided with a wild card to be used in the same way.

Such wild cards serve to add excitement and create higher hand values. Wild cards could also be designed to be retained permanently by players and if decorated appropriately by an issuing casino or the like would serve the dual purpose of a playing card and a promotional item.

Wild cards may be used in this way in conjunction with other forms of card games. Thus various embodiments of the present invention also provide methods of playing the card-type game involving one or more persons acting as a dealer and a banker, and at least one player, the method comprising the steps of:

(a) each player receiving a wild card which the player retains throughout the game for use with each hand of cards dealt to him;

(b) the dealer dealing to each player successive hands of cards as the game progresses, each hand of cards being played in accordance with the rules before the next hand is dealt;

(c) the player using the wild card in conjunction with each hand to improve the rank of the hand in accordance with predetermined hand rankings.

The invention also provides game apparatus for use in playing the card-type games of the present invention. For example, the games of the present invention are readily adaptable for play on a board game or on a gaming device, such as a video gaming device.

For example, one aspect of the present invention comprises an apparatus for playing a card-type game comprising:

means for informing at least one player of a hierarchy of a plurality of possible hands and a predetermined plurality of winning card combinations;

means for receiving at least one wager selection from a plurality of wagering options by said at least one player, wherein said wagering options at least comprise:

(a) whether player's hand attains at least one of said predetermined plurality of winning combinations; and (b) whether said player's hand has a higher ranking than a hand of said dealer; and means for displaying a plurality of indicia of playing cards to form at least one player's hand and a dealer's hand.

Another aspect of the present invention comprises an apparatus for playing a card game comprising a plurality of playing cards of similar construction and a combined playing and promotional card, wherein one face of said combined playing/promotional card comprises a playing face compatibly usable with the other cards and the opposite face of which comprises advertising or publicity indicia, the combined playing and promotional card being of more durable construction than the other cards.

According to a further aspect of the invention there is provided apparatus for use in playing a card game in which all possible hands of cards are ranked according to predetermined rules, the apparatus comprising a dealer's playing area and a plurality of player's playing areas, each player's playing area comprising a first zone in which a player may place a wager that the player's hand will be greater than a first predetermined rank, and a second zone in which a player may place a wager that the player's hand will beat the dealer's hand.

Preferably each of said player's playing areas also includes a third zone adapted to receive cards which remain in play after the player has inspected his hand and decided to continue playing the game.

In addition each player's play area preferably includes a further zone into which the player may place a play wager after having inspected his cards and decided to continue playing the game. The further zone may be superimposed upon the third, card-receiving zone.

The apparatus may also incorporate a chip tray to receive playing chips, the chip tray being placed in a position adjacent or convenient to the dealer. The apparatus may also incorporate an area or receptacle for cards not in play.

The apparatus may comprise a rigid playing surface of board, plastic or other suitable material or may comprise a cloth or other flexible material defining a playing surface.

In a preferred form, the surface is of generally semi-circular form, the dealer's playing area being located proximate the straight edge of the playing surface or centrally thereof and the players' playing areas being disposed side-by-side in arcuate array adjacent the curved edge of the playing surface.

According to a still further aspect of the invention there is provided game apparatus comprising a plurality of playing cards of known construction and a combined playing and promotional card, one face of which comprises a playing face compatibly usable with the other cards and the opposite face of which comprises advertising or publicity material, the combined playing and promotional card preferably being of more durable construction than the other cards.

Preferably said opposite or back face of the combine playing and promotional card is readily distinguishable from the back faces of the other cards.

The playing surface of the combined playing and promotional card may advantageously represent a wild card usable to represent and be substituted for a card of any rank incorporated in the remaining cards.

Advantageously, a preferred combined playing and promotional card is formed from flexible plastics material and is of substantially the same area as the other cards but of increased thickness. The card may, for example, be of approximately twice the thickness of the other cards.

BRIEF DESCRIPTION OF THE DRAWINGS

Embodiments of the invention will now be described, by way of example only, with reference to the accompanying drawings, in which.

DETAILED DESCRIPTION

The various embodiments of the present invention are directed to card-type games wherein indicia of playing cards are displayed to one or more players and/or a dealer. As used herein, the phrase "indicia of playing cards" is meant to include actual playing cards, as well as images of playing cards displayed either mechanically, electro-mechanically, electronically or otherwise. For example, it is well within the scope of the present invention to display indicia of playing cards on an actual board game, on a mechanical slot machine, on an electronic gaming device, on another video screen, or utilizing another form of image generation such as holography. Similarly, the phrase "indicia of wild cards" as used herein may include jokers from a standard deck of playing cards but may also comprise other indicia which, according to rules of the game, may be used for at least one other value.

Figure 1:
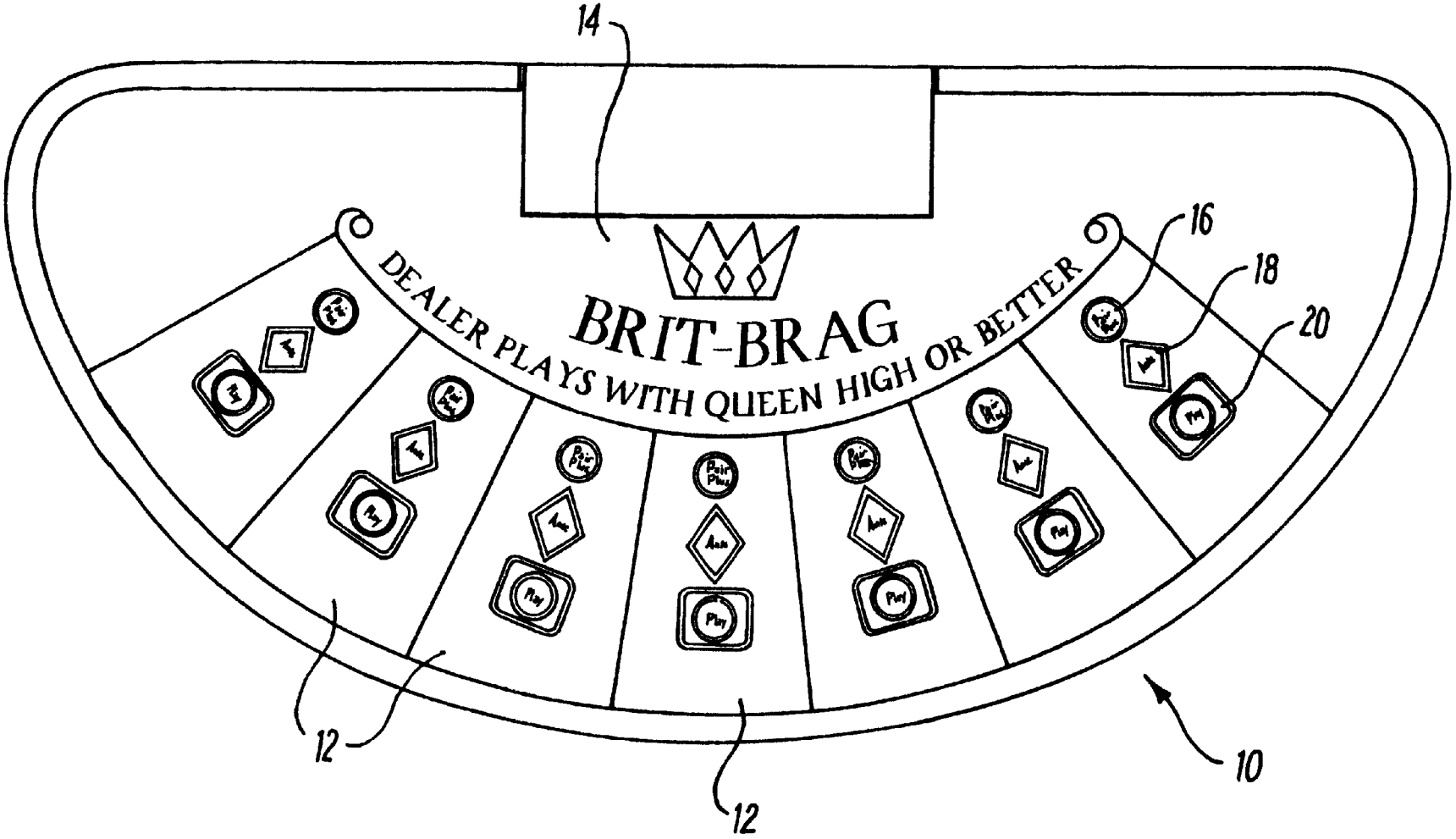
FIG. 1 shows a playing surface for use in playing a card game of one embodiment of the present invention.
Figure 1A:
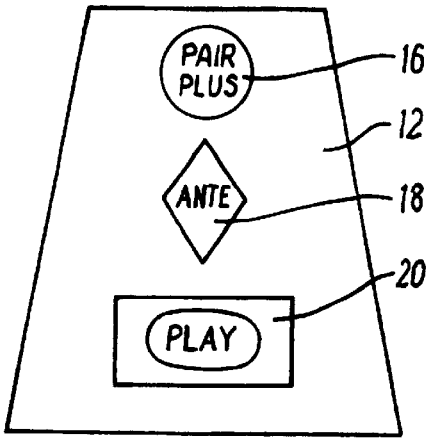
FIG. 1A illustrates one player area of the playing surface shown in FIG. 1.

FIG. 1 shows a playing surface or table layout 10 on which one embodiment of the present invention may be played. The layout 10 may be marked or placed on any suitable surface such as a gaming table. For example, the layout may be in the form of a layout cloth supported on a supporting surface. The layout provides a playing area 12 for a plurality of players, for example seven players, and a separate area 14 for a banker who also preferably acts as dealer. Each playing area 12 has a number of marked sections or zones 16, 18, 20 for the placing of various wagers by a player as will be described hereinafter.

Each player takes a place at one of the areas 12. The game is played in a number of rounds as will be described. In each round, each player has the option of playing against the dealer, or wagering on the rank of his hand, or playing a combination of these two options. The game can be played with a standard 52-card deck or a modified deck as described herein.

At the commencement of the game each player decides whether to play the particular round by wagering against the dealer, i.e. an "ANTE" wager, by wagering on the value of his hand, i.e. a "PAIR PLUS" wager, or both. To play against the dealer a player makes an ANTE wager by placing an appropriate wager, such as a token or chip, on the section 18 of his playing area 12. The gaming chips may be of any conventional kind and available in a number of denominations such as are well known within the art. If the player wishes (alternatively or in addition) to make a wager based on the value of his hand, he places an appropriate token or chip on PAIR PLUS section 16 of his playing area 12. In the present example, the rules of the game provide that payouts will be made according to a displayed payout schedule with "PAIR PLUS" payouts starting at a pair or better. In the three-card version of the game, hands are preferably ranked according to the following hierarchy, though other rankings may be used:

| | | | |
|---|---|---|---|
| Highest: | BRAG: | Three of one suit in sequence | |
| | | AKQ | highest ranking brag |
| | | KQJ | next highest ranking brag |
| | | QJ10 | next highest ranking brag, and so on until |
| | | 32A | lowest ranking brag |
| | TRIPS: | Three of One Rank | |
| | | AAA | highest |
| | | KKK | next highest ranking trips, and so on until |
| | | 222 | lowest ranking trips |
| | RUN: | Three of mixed suits in sequence | |
| | | AKQ | highest ranking |
| | | KQJ | next highest ranking, and so on, until |
| | | 32A | lowest ranking |
| | FLUSH: | Three of One Suit | |
| | | AKJ | highest ranking |
| | | AK10 | next highest, and so on, until |
| | | 532 | lowest ranking |
| | PAIR: | Two of Same Rank | |
| | | AAK | highest ranking |
| | | AAQ | next highest ranking, and so on, until |
| | | 223 | lowest ranking |
| Lowest: | HIGH CARD | (a hand comprising none of the above) | |
| | | AKJ | highest ranking |
| | | AK10 | next highest ranking, and so on, until |
| | | 532 | lowest ranking |
| | Ace is high, but can be low in 3-2-A Sequence. | | |

The payout schedule may be varied in accordance with rules of the game and/or by the casino. For example, one preferred payout schedule is as follows:

BRAG 40 to 1

TRIPS 30 to 1

RUN 6 to 1

FLUSH 4 to 1

PAIR 1 TO 1

Alternatively, in a gaming establishment or jurisdiction where high odds payouts are not favored, a wager can be made that the value of the hand will be a pair or greater, and the payout may be, for example, 14 to 5.

Figure 2:
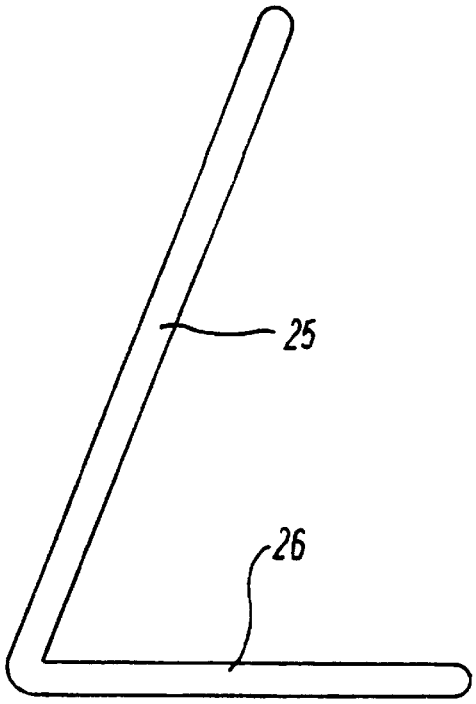
FIG. 2 is a side view of the payout sign.
Figure 3:
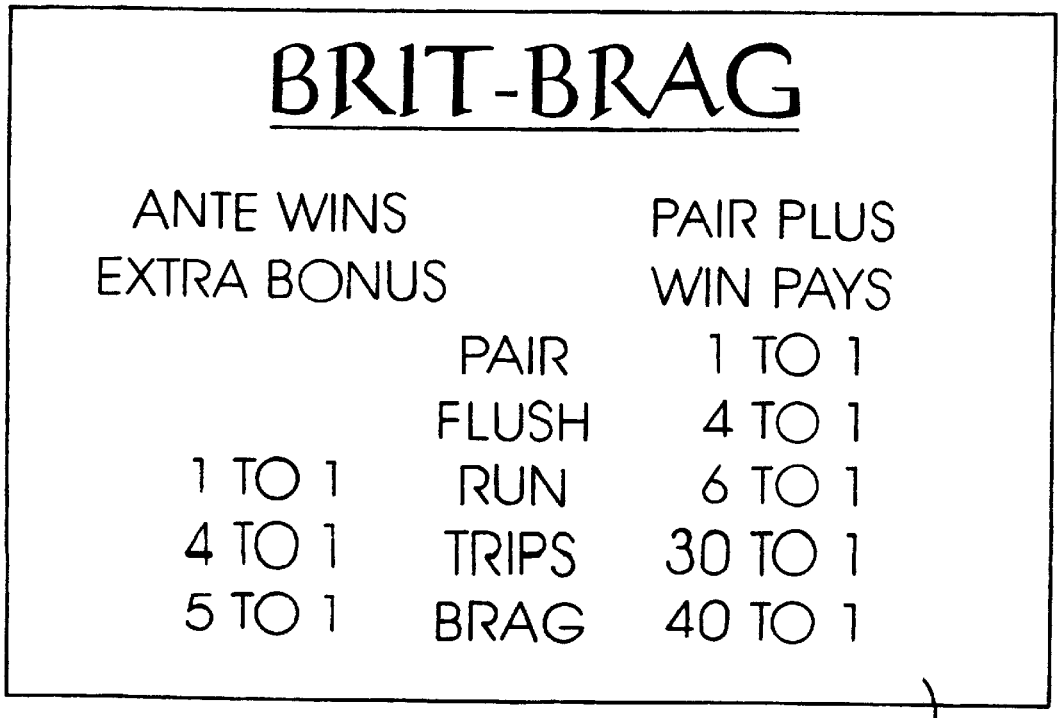
FIG. 3 is a front view of the sign shown in FIG. 2.

The payout schedules are preferably displayed in a convenient manner and location. FIGS. 2 and 3 show a payout sign comprising an inclined display area 25 and a horizontal base 26. In an alternative arrangement, details of payouts and any extra bonus payouts may be marked on each player's playing area 12.

According to a preferred embodiment of the present invention, the two wagering options are independent, so that a player may wager unequal amounts on the ANTE and PAIR PLUS options.

When the above wagers are in place, the dealer preferably shuffles the cards (manually or otherwise) and then deals a three-card hand to each player and to himself.

The cards may initially be dealt to the players face up or face down depending upon casino policy.

When the cards have been dealt, any player who has placed an ANTE wager inspects his hand and determines whether he wishes either to forfeit his ANTE wager and not to play the hand, or to continue. If he wishes to continue, according to this illustrated embodiment, he must place a PLAY wager, which must be of proportionate value to and is preferably the same as the ANTE wager. The PLAY wager is made by placing an appropriate chip on the section 20 marked "PLAY" on his playing area 12. When he has made the wager he places his cards in the PLAY area below the PLAY wager section 20.

If a player forfeits his ANTE wager this is taken by the banker and the player's cards are discarded before the game proceeds.

"PAIR PLUS" wagers are not affected to his point. However, a player playing "PAIR PLUS" only, places his cards in the playing area. If the player is also playing against the dealer with an ANTE wager, he must make a PLAY wager if he has a winning PAIR PLUS wager.

The dealer reveals his cards and arranges the cards to show the value of his hand. The dealer then in turn reveals each other player's hand (if not already visible) and resolves each player's wager(s).

All players with ANTE and PLAY wagers are automatically winners if the dealer does not have a queen high hand or better. This rank may be varied in accordance with rules of the game or of the casino. Players are preferably paid even money on their ANTE wager and their PLAY wager is returned.

If the dealer has a queen high hand or better, each player's hand is compared with that of the dealer. If the player's hand is higher, the player is paid even money on both ANTE and PLAY wagers. If the player's hand is lower, the player forfeits his ANTE and PLAY wagers. If the dealer and player have the same hand the player may either withdraw his wager or leave or amend it for the next round.

Preferably an additional payout is made by the banker to any player who is in play against the dealer, i.e. who has made ANTE and PLAY wagers, and who has a hand of a high rank. The ranks to which such extra BONUS payments are made may be predetermined by rules of the game and/or the casino. One preferred schedule is as follows:

BRAG 5 to 1

TRIPS 4 to 1

RUN 1 to 1

Alternatively, the payout may be 7 to 5 for a run or higher ranking hand. The payout is preferably based on the ANTE wager.

Players who have wagered on the value of the hand (i.e. PAIR PLUS wagers) win if the hand is at least a pair, and are paid by the banker according to the posted scale. These payouts are independent of the results of the game against the dealer.

This procedure completes a single round of the game. Play then continues in another round, with players commencing by making ANTE and/or PAIR PLUS wagers.

Figure 7:
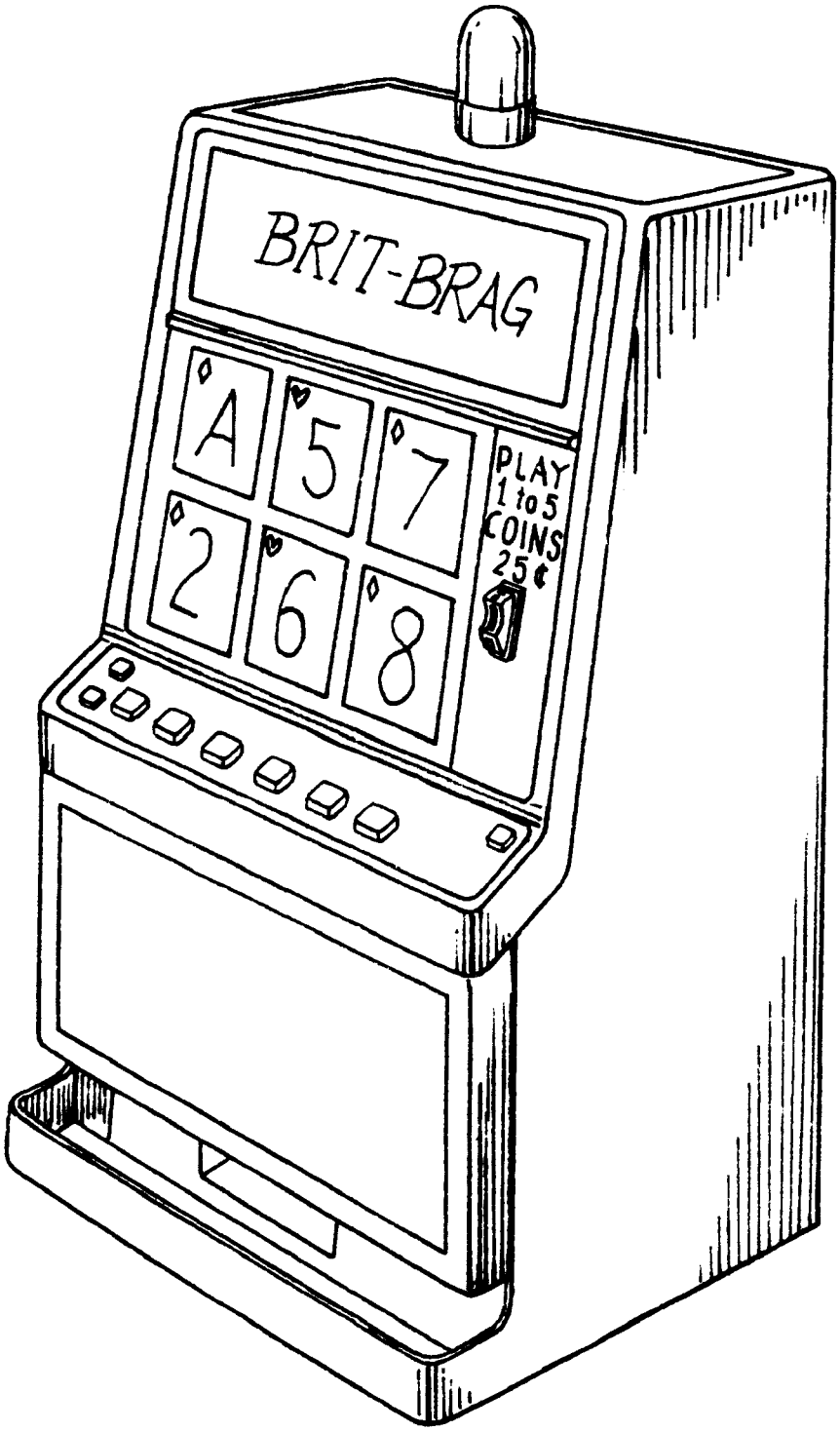
FIG. 7 illustrates a gaming device embodiment of the present invention.

The novel methods of the present invention may be played utilizing playing cards as illustrated above, or on an electrical or electromechanical device such as the gaming device illustrated in FIG. 7. Those skilled in the art will appreciate that suitable controls can be provided for receiving the necessary input and therefore will not be described in detail herein. While the gaming device illustrated in FIG. 7 is intended for play by a single player against the playing device, it is also within the scope of the present invention to provide a multi-unit video format wherein a plurality of players may play against each other and/or against a dealer. Similarly, from the present description, those skilled in the art will appreciate that the novel games of the present invention are readily adaptable for play either within a gaming establishment or at a remote location, such as on a terminal provided in a commercial aircraft. Furthermore, the game is readily adaptable to a scratch card format.

Figure 4:
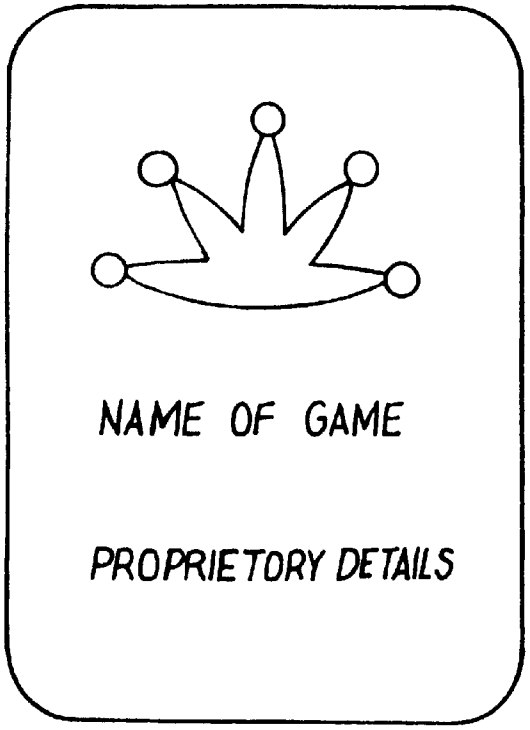
FIGS. 4 and 5 are views of opposite faces of a combined playing and promotional card.
Figure 5:
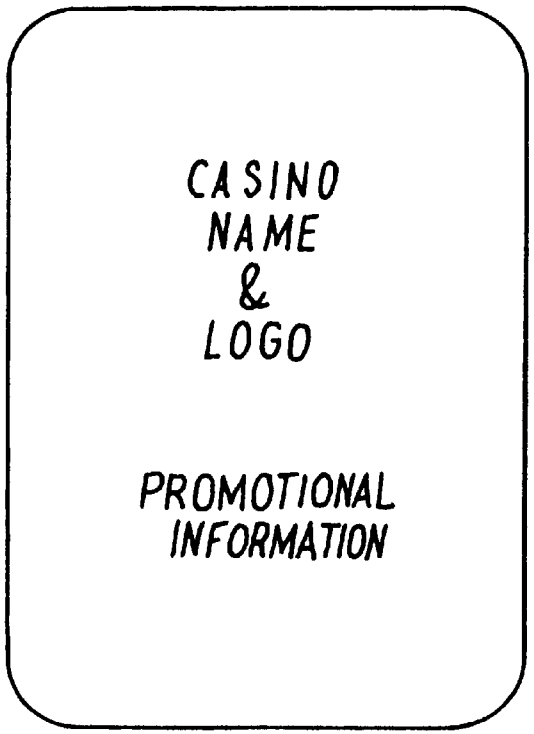
Figure 6:
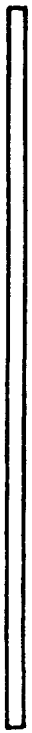
FIG. 6 is an end view of the card shown in FIGS. 4 and 5.

FIGS. 4–6 show a combined playing and promotional card which may be used separately or in conjunction with one of the other embodiments of the present invention. The card shown in FIGS. 4–6 is of the same shape, length and width as conventional playing cards used in the game but is of more durable construction. Preferably the card is produced from flexible plastic material and is substantially thicker than the normal playing cards. The card may, for example, be approximately twice the thickness of the normal cards.

The card is used as a wild card. The front face of the card is shown in FIG. 4 and incorporates a logo or illustration appropriate to a wild card together with other matter such as the name of the game, a proprietary rights statement and/or other indicia as desired by the gaming establishment, such as the name and location of the gaming establishment. From the present description, those skilled in the art will appreciate that other desired indicia may also be included for promotional purposes. Thus, the rear face of the wild card is of a different appearance from the rear faces of the normal playing cards and preferably incorporates the name and possibly a logo of the casino or the like together with other promotional information.

The card of FIGS. 4–6 has a dual function; in playing the game it is used as a wild card; subsequently the card can be taken away by the player and retained as a momento and also serves as a promotional item. In a three-card version of the game described above, a player may be provided with two standard cards and a wild card to form a three-card hand. Alternatively, at least one player may be provided with three cards and be permitted to discard one card in order to form his/her best three-card hand using the wild card. Similarly, in four and five-card versions of the game a wild card of the kind shown in FIGS. 4–6 may be issued to each player and to the dealer. The players and dealer then use the wild card repeatedly in conjunction with each four card hand dealt to them to make a five-card poker hand. In a five-card game each player and the dealer may substitute the wild card for any card in their hand to improve the five-card hand they hold. This has the result of creating higher hand values and adding excitement to the game. According to each of these embodiments, the dealer is also preferably provided with the same number of standard cards and a wild card as provided to each player.

The card of FIGS. 4–6 is thus a novel article for use in playing one or more card games, including those of the present invention as well as other card games, and serves the dual function of being usable and distinguishable from the other cards in play, and serving as a momento and promotional item to be retained by the player.

From the present description, those skilled in the art will appreciate that various modifications may be made without department from the scope of the present invention. For example, the naming of the wagers, the naming and/or ranking of any hand, the payout schedule and predetermined winning or losing ranks may be varied in accordance with the requirements of the casino. The table layout may be varied from that described and shown. The rules may be varied, or additional rules imposed, within the scope of the invention.

In particular, there may be introduced a further option of a player wagering on a high odds payout wager or on a fixed or variable jackpot which is paid out in accordance with rules of the casino on a premium hand, or when a high ranked hand is beaten by the dealer. Examples of odds available could be 5000 to 1 or more against a royal brag—ace, king, queen suited or up to 250,000 to 1 or more against a brag being beaten by a higher brag. Alternatively the player's hand may be combined with the dealer's hand to form a six-card hand offering odds of up to 4,000,000 to 1 or more against ace to nine in the same suit. Two or more of these wagers could be combined with suitably reduced odds and if desired consolation payouts could be made to players having hands less than the premium hand/and or to other players who have taken part in the jackpot.

According to a still further embodiment of the present invention, a player may be provided with a payout based on one or more of the following:

(a) a player's hand of a specified ranking could be an automatic winner, with a payout based either on the ANTE or the PLAY wager or both, regardless of the contest against the dealer i.e. even if the dealer has a higher hand than the player;

(b) a player's hand of specified ranking could be an automatic non-loser, i.e. the player's stake is returned, based on either the ANTE or PLAYER wager or both regardless of the contest against the dealer i.e. even if the dealer has a higher hand; and/or (c) a player's hand of specified ranking could win the PLAY wager if the dealer's hand is of a specified ranking below the dealer's minimum specified ranking (i.e. in the embodiment described above the specified ranking is queen high or better, so that the additional specified ranking could be jack high or lower).

Where the game incorporates a jackpot or a numerical hand value wager, separate designated wagering areas may be provided for these wagers. These may be incorporated at any convenient position on the players' playing areas. The display stand, the wild and promotional card may also be modified or omitted as desired.

Whilst the game is described particularly for play in a gaming establishment, it is not limited in this respect and may also be played for example in a domestic environment or in the format of a video game, slot machine or the like.

What is claimed is:

1. A computer apparatus configured for playing a card game, comprising:

A) first wager selection means for receiving a first wager selection from a player, wherein first wager selections include:

1) a first bet that said player will have a card hand that exceeds a first predetermined rank, and 2) a second bet that said player will have a card hand that exceeds a dealer card hand; and B) second wager selection means for receivinig a second wager selection from said player after a player card hand consisting of three cards and a dealer card hand consisting of three cards are dealt and if said player placed said second bet, wherein second wager selections include:

i) a third bet that said player's card hand consisting of three card exceeds said dealer's card hand consisting of three cards and the dealer card hand exceeds a second predetermined rank; and ii) a forfeiture of said second bet, wherein said computer apparatus detennines both whether said dealer card hand exceeds the second predetermined rank and whether or not the player card hand has a rank that is higher than said dealer card hand that exceeds said second predetermined rank.

2. The apparatus according to claim 1, further comprising:

display means for displaying a plurality of indicia of playing cards to form said player card hand and said dealer card hand;

first determining means for determining whether said player card hand exceeds said first predetermined rank if said player has placed said first bet, wherein if said player card hand exceeds said first predetermined rank, paying said player a fixed payout bet in accordance with a predetermined scale; and second determining means for determining whether said dealer card hand exceeds said second predetermined rank if said player placed said second bet, wherein:

if said dealer card hand does not exceed said second predetermined rank, paying said player an amount based on said second bet and returning said third bet to said player, and if said dealer card hand exceeds said second predetermined rank, comparing said dealer card hand with said player card hand wherein:

if said player card hand is higher than said dealer card hand, paying said player an amount based on both said second and said third bets, and if said player card hand is lower than said dealer card hand, forfeiting both said second and said third bets.

3. The apparatus according to claim 2, wherein said display means initially conceals at least some of said indicia of playing cards of said dealer card hand and wherein said second wangler selection means must require an increased wager from said player, if said second bet is placed, after said display means displays said player card hand indicia but before said display means displays said dealer card hand concealed indicia.

4. The apparatus according to claim 2, wherein said indicia of playing cards are standard playing cards.

5. The apparatus according to claim 1, wherein said player card hand and said dealer card hand each includes indicia of a wild card.

6. The apparatus according to claim 1, wherein said first wager selection means provides said player with the option of selecting both said first bet and said second bet.

7. The apparatus according to claim 1, wherein said first wager selection means requires said player to place said first bet and provides said player with an option of placing said second bet.

8. The apparatus according to claim 1, wherein said first wager selection means requires said player to place said second bet and provides said player with an option of placing said first bet.

9. The apparatus according to claim 1, further comprising means for informing a player of a hierarchy of a plurality of possible card hands and a predetermined plurality of winning card combinations.

10. The apparatus according to claim 1, further comprising player wild card means for displaying indicia of a wild card and for receiving optional selection of said wild card for use with said player card hand.

11. The apparatus according to claim 1, further comprising dealer wild card means for displaying indicia of a wild card and for use with said dealer card hand.

12. The apparatus according to claim 1, wherein said first bet and said second bet are not optional.

13. The apparatus according to claim 12, wherein said additional wager options include:

an automatic payout, if said player placed said second bet, and said player card hand is of a third predetermined ranking even though said dealer card hand is of a higher ranking than said player card hand;

a return of a portion of said player's wager, if said player placed said second bet, and said player card hand is of said third predetermined ranking even though said dealer card hand is of a higher ranking than said player card hand; and/or a payout if said dealer card hand has a ranking below a fourth predetermined minimum ranking.

14. The apparatus according to claim 1, wherein said player card hand includes two indicia of standard playing cards and indicia of a wild card.

15. The apparatus according to claim 1, further comprising a jackpot means for receiving a jackpot bet.

16. The apparatus according to claim 1, further comprising numerical hand value means for receiving a numerical hand value bet.

17. The apparatus according to claim 1, wherein said apparatus is an electronic gaming device.

18. The apparatus according to claim 1, wherein said apparatus is a video gaming device.

19. The apparatus according to claim 18, wherein said video gaming device is a computer and said first wager selection means and said second wager selection means are implemented in software for controlling said computer.

20. The apparatus according to claim 19, wherein said software is stored on a disk.

21. The apparatus according to claim 20, wherein said disk is an optical compact disk.

22. The apparatus according to claim 1, further comprising a first zone for placing said first bet and a second zone for placing said second bet.

23. The apparatus according to claim 1, further comprising a third zone for placing said player card hand when said player decides to continue playing the card game.

24. The apparatus according to claim 1, further comprising a fourth zone for placing a play wager when said player decides to continue playing the card game.

25. The apparatus according to claim 24, wherein said fourth zone is superimposed upon said third zone.

26. The apparatus according to claim 1, further comprising means for informing said player of a hierarchy of a plurality of possible card hands and a predetermined plurality of winning card combinations and wherein a lowest rank hand of said predetermined plurality of winning card combinations is pair.

27. The apparatus according to claim 1, wherein said second predetermined rank comprises a high card hand containing a queen.

28. The apparatus according to claim 1, wherein said hands are ranked according to the following scale, wherein A=ace, K=king, Q=queen, J=jack, and number 10 to 2 designate the other cards:

| | | |
|---|---|---|
| Highest: | BRAG: | Three of one suit in sequence<br>AKQ highest ranking brag<br>KQJ next highest ranking brag<br>QJ10 next highest ranking brag,<br>and so on, until |
| | TRIPS: | Three of One Rank<br>AAA highest ranking trips<br>KKK next highest ranking trips,<br>and so on, until<br>222 lowest ranking trips |
| | RUNS: | Three of mixed suits in sequence<br>AKQ highest ranking<br>KQJ next highest ranking,<br>and so on, until<br>32A lowest ranking |
| | FLUSH: | Three of one Suit<br>AKJ highest ranking<br>AK10 next highest, and so on,<br>until<br>532 lowest ranking |
| | PAIR: | Two of Same Rank<br>AAK highest ranking<br>AAQ next highest ranking, and so on,<br>until<br>223 lowest ranking |
| Lowest: | HIGH CARD | (a hand comprising none of the above)<br>AKJ highest ranking<br>AK10 next highest ranking, and so on,<br>until<br>532 lowest ranking |

29. The apparatus according to claim 1, further comprising an additional payout step to said player when said player placed said second bet and a further wager, if said player card hand is any of a number of specified high ranking hands.

30. The apparatus according to claim 29, wherein said additional payout step resolves said additional payout based said second bet.

31. The apparatus according to claim 29, wherein said additional payout is made in accordance with the following scale:

BRAG 5 to 1

TRIPS 4 to 1

RUN 1 to 1.

32. The apparatus according to claim 1, wherein said first bet is a fixed payout bet according to the following, scale:

BRAG 40 to 1

TRIPS 30 to 1

RUN 6 to 1

FLUSH 4 to 1

PAIR 1 to 1.

33. A computer apparatus configured for displaying indicia of cards and playing a card ,anie, the apparatus comprising:

first waiter selection means for receiving a first wager selection from a player, wherein first wager selections include:

a first bet that said player will have a card hand that exceeds a first predetermined rank, wherein a plurality of hands are ranked according to predetermined rules and wherein said first bet is a fixed payout bet, and a second bet that said player will have a card hand that exceeds that of a dealer;

second wager selection means for receiving a second wager selection from said player, after a player card hand consisting of three cards and a dealer card hand consisting of three cards are dealt and if said player placed said second bet, wherein second wager selections include:

i) a third bet that said player's card hand consisting of three cards exceeds said dealer's card hand consisting of three cards, and the dealer card hand exceeds a second predetermined rank, and ii) a forfeiture of said second bet, first determining means for determining whether said player card hand exceeds said first predetermined rank if said player placed said first bet, wherein if said player card hand exceeds said first predetermined rank, paying said player said fixed payout bet in accordance with a predetermined scale; and second determining means for determining whether said dealer card hand exceeds a second predetermined rank if said player placed said second bet, wherein:

if said dealer card hand does not exceed said second predetermined rank, paying said player an amount based on said second bet and returning said third bet to said player, and if said dealer card hand exceeds said second predetermined rank, comparing said dealer card hand with said player card hand wherein:

if said player card hand is higher than said dealer card hand, paying said player an amount based on both said second and said third bets, and if said player card hand is lower than said dealer card hand, forfeiting both said second and said third bets.

34. The apparatus according to claim 33, wherein said player card hand and said dealer card hand each includes indicia of a wild card.

35. The apparatus according to claim 33, wherein said player card hand and said dealer card hand each includes indicia of two standard cards and one wild card.

36. The apparatus according to claim 33, wherein said first wager selection means provides said player with the option of selecting both said first bet and said second bet.

37. The apparatus according to claim 33, wherein said first wager selection means requires said player to place said first bet and provides said player with an option of placing said second bet.

38. The apparatus according to claim 33, wherein said first wager selection means requires said player to place said second bet and provides said player with an option of placing said first bet.

39. A computer apparatus configured for displaying indicia of cards and playing a card game, the apparatus comprising:

first wager selection means for receiving a first wager selection from a player, wherein first wager selections include:

a first bet that said player will have a card hand that exceeds a first predetermined rank, and a second bet that said player will have a card hand that exceeds that of a dealer;

second wager selection means for receiving a second wager selection from said player after a player card hand consisting of three cards and a dealer card hand consisting of three cards are dealt and if said player placed said second bet, wherein second wager selections include:

i) a third bet that said player's card hand consisting of three cards exceeds said dealer's card hand consisting of three cards, and the dealer card hand exceeds a second predetermined rank, and ii) a forfeiture of said second bet, first determining means for determining whether said player card hand exceeds said first predetermined rank if said player placed said first bet, wherein if said player card hand exceeds said first predetermined rank, paying said player a fixed payout bet in accordance with a predetermined scale; and second determining means for determining whether said dealer card hand exceeds a second predetermined rank if said player placed said second bet, wherein:

if said player card hand is higher than said dealer card hand, paying said player an amount based on both said second and said third bets, and if said player card hand is lower than said dealer card hand, forfeiting both said second and said third bets.

40. The apparatus according to claim 39, wherein at least one of said first bet and said second bet must be placed to begin play.

41. The apparatus according to claim 39, wherein said apparatus is an electronic gaming device.

42. The apparatus according to claim 41, wherein said electronic gaming device includes said first wager selection means, said second wager selection means, said first determining means, and said second determining means.

* * * * *